United States Patent [19]

Gilbos

[11] Patent Number: 4,763,849

[45] Date of Patent: Aug. 16, 1988

[54] YARN GUIDE DEVICE FOR WINDING CROSS-WOUND BOBBINS IN TEXTILE MACHINES

[75] Inventor: George E. Gilbos, Aalst, Belgium

[73] Assignee: Textielmachinefabriek Gilbos Naamloze Vennootschap, Belgium

[21] Appl. No.: 38,372

[22] Filed: Apr. 15, 1987

[30] Foreign Application Priority Data

Sep. 22, 1986 [BE] Belgium ..... 2/61055

[51] Int. Cl.[4] ..... B65H 54/28

[52] U.S. Cl. ..... 242/43.2; 242/43 A

[58] Field of Search ..... 242/43.2, 43 R, 43 A

[56] References Cited

U.S. PATENT DOCUMENTS

| | | | |
|---|---|---|---|
| 1,926,049 | 9/1933 | Kelley | 242/43.2 |
| 1,990,620 | 2/1935 | Schweiter | 242/43.2 |
| 2,156,472 | 5/1939 | Dersen | 242/43.2 |
| 3,374,961 | 3/1968 | Otsuka et al. | 242/43 A |
| 3,861,607 | 1/1975 | Schippers et al. | 242/43.2 X |
| 4,485,618 | 12/1984 | Anzinger | 242/43.2 X |

FOREIGN PATENT DOCUMENTS

| | | | |
|---|---|---|---|
| 1005880 | 4/1957 | Fed. Rep. of Germany | 242/43.2 |
| 831224 | 5/1938 | France | 242/43.2 |
| 833092 | 7/1938 | France | 242/43.2 |
| AD.49280 | 11/1938 | France | 242/43.2 |
| AD.49392 | 12/1938 | France | 242/43.2 |
| 232345 | 8/1944 | Switzerland | 242/43.2 |

*Primary Examiner*—Stanley N. Gilreath
*Attorney, Agent, or Firm*—William A. Drucker

[57] ABSTRACT

A yarn guide device for the formation of cross-wound bobbins in textile machines, comprising a driven cylinder having over the entire length of its outer surface an uninterrupted helical groove for guiding the yarn in one direction of the transverse movement with respect to the direction of the run movement of the yarn and a helical groove running in the opposite direction and interrupted by the first groove for guiding the yarn in the other direction of the transverse movement of the yarn; a rotating driven rotor installed before and under said driven grooved cylinder; said rotor including at least one carrier for pre-aligning the yarn during its transverse motion imposed by the uninterrupted groove of said grooved cylinder; and means for driving the rotor with a speed having an unchanging relationship to the speed of rotation of the grooved cylinder.

5 Claims, 5 Drawing Sheets

YARN GUIDE DEVICE FOR WINDING CROSS-WOUND BOBBINS IN TEXTILE MACHINES

Figure 1:
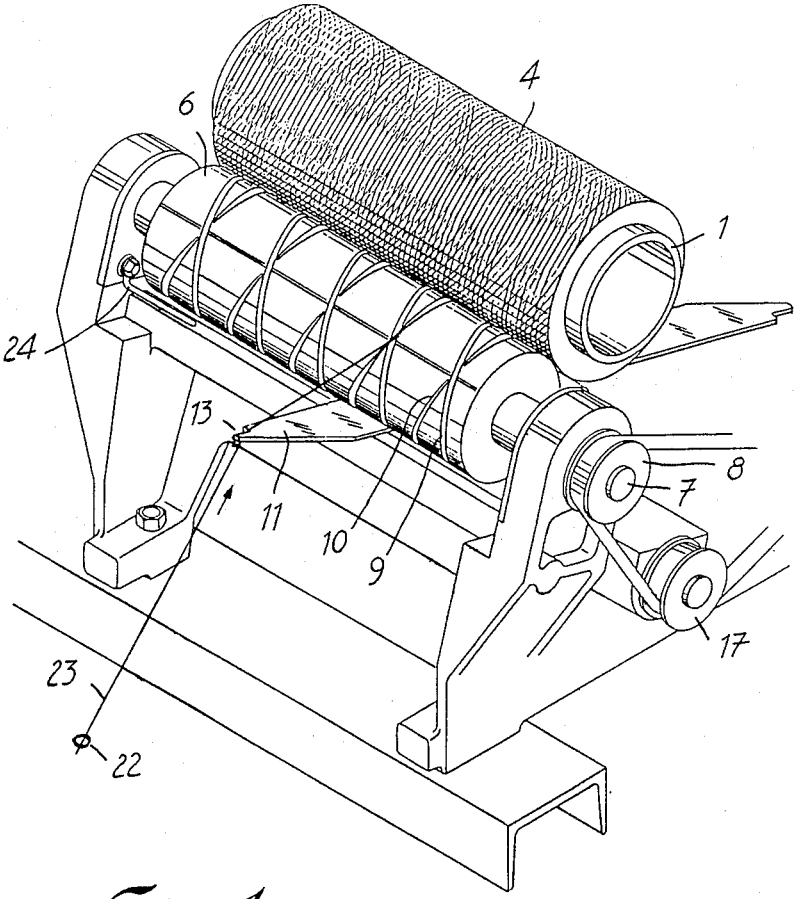

The invention concerns a yarn guide device for obtaining cross-wound bobbins in textiles winding machines of the sort where the yarn to be wound up is wound back and forth from a fixed point by means of a rotating driven grooved cylinder onto a driven bobbin which is also rotating.

A device is known which in essence consists of a grooved cylinder. This cylinder has two helical grooves of differing depth which run in opposite directions, where on the left half of the cylinder the shallower groove which guides the yarn to the right is interrupted by the deeper groove which guides the yarn from right to left; in contrast on the righthand side of the cylinder the shallower groove, which guides the yarn from right to left, is interrupted by the deeper groove which guides the yarn from left to right.

The disadvantage of this yarn guide system is, however, that the yarn can get into one groove from the other before the reversing points at the extremities are reached, making unsatisfactory yarn guiding possible.

A device is also known in which use is made of a double yarn guide device, consisting of:

a grooved cylinder, fitted in the yarn line immediately in front of the bobbin to be wound, which guides the yarn from one to the other reversing point of the bobbin being wound;

an auxiliary yarn guide device installed in the yarn line immediately in front of the grooved cylinder, that guides the yarn both from left to right and from right to left, and wihch is intended to ensure that the yarn is always guided into the correct groove of the cylinder.

The disadvantage of this yarn guide device is that it is of a rather complicated construction.

In order to compensate for the aforementioned disadvantages, a yarn guide device has according to the main characteristics of the invention been realized which combines a simple construction with efficient yarn guiding and which consists primarily of:

a. a rotating driven grooved cylinder which is placed in the yarn line immediately before the bobbin to be wound for guiding the yarn from one to the other reversing point of the bobbin to be wound, whereby said cylinder is provided over the entire length of its stroke with a relatively deep uninterrupted groove and with a second relatively shallow groove which is interrupted by the first groove at the places where they cross;

b. an additional yarn guide device, installed in the yarn line immediately in front of the grooved cylinder, which serves to prealign the yarn only during the transverse movement of the yarn when the yarn is being guided over the cylinder through the shallow groove.

During the opposing transverse movement of the yarn prealignment is in fact unnecessary because the yarn is guided during this motion by the deep uninterrupted groove.

Because the additional yarn guide device only has to operate in one direction of motion of the yarn, it can be of a very simple construction, for example non-restrictive, taking the form of a rotor with two arms, this rotor moving synchronously with and driven at a suitable proportional speed with respect to the cylinder.

Furthermore the guide device according to the invention makes it possible to obtain conical bobbins by varying the pitch of the grooves in the cylinder and by giving the grooved cylinder and the additional yarn guide device a suitable speed. It is also possible to obtain precision and cross-wound bobbins, where the first type of bobbins are driven in their centres, and the second sort are driven on their circumference.

Figure 2:
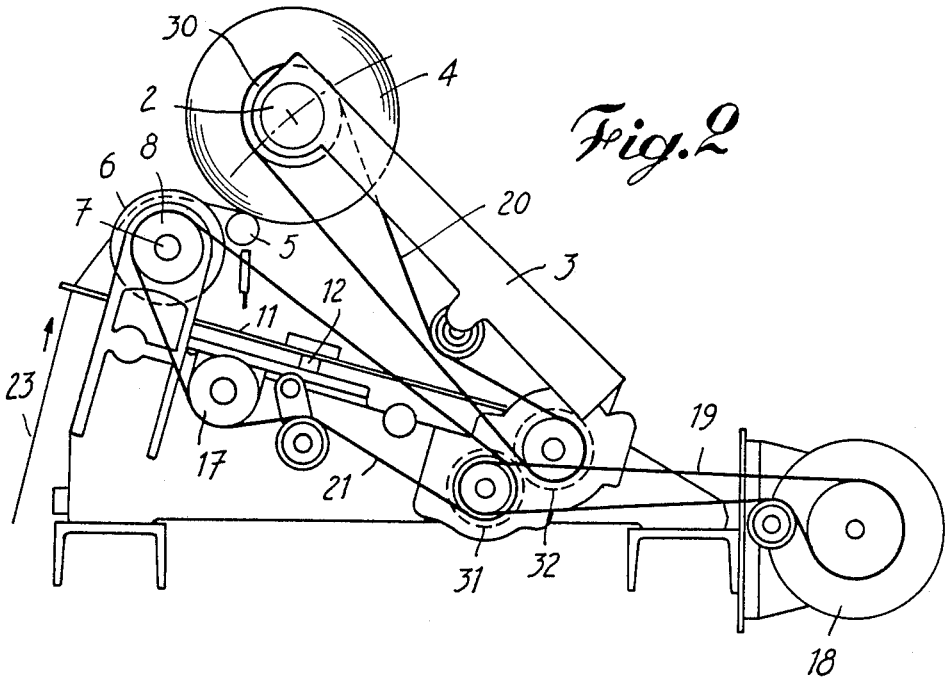
Figure 3:
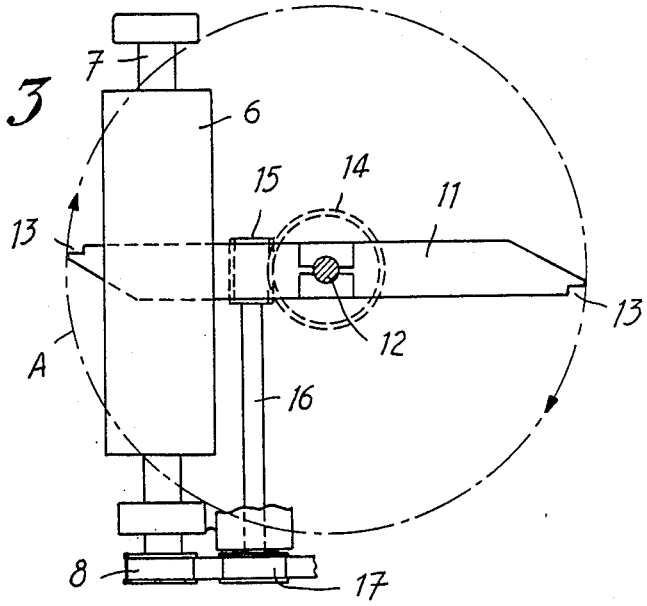
Figure 4:
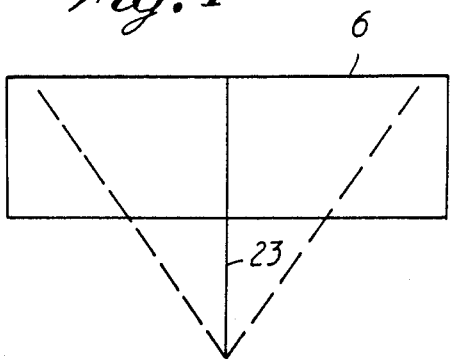
Figure 5:
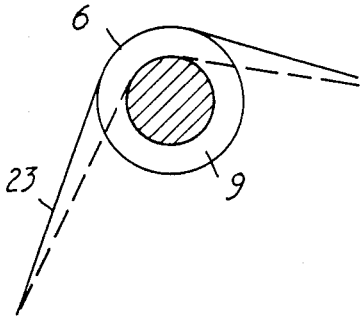
Figure 6:
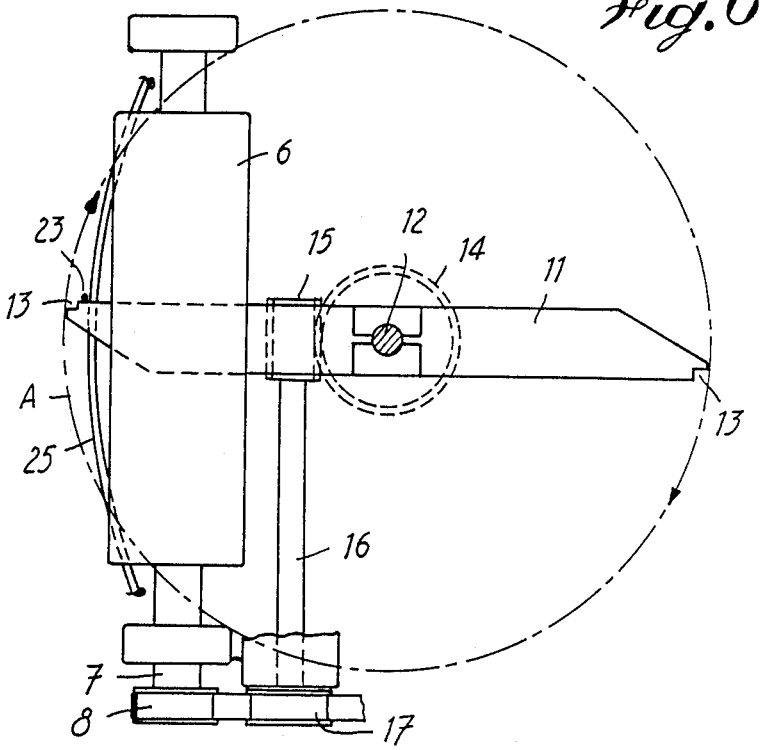
Figure 7:
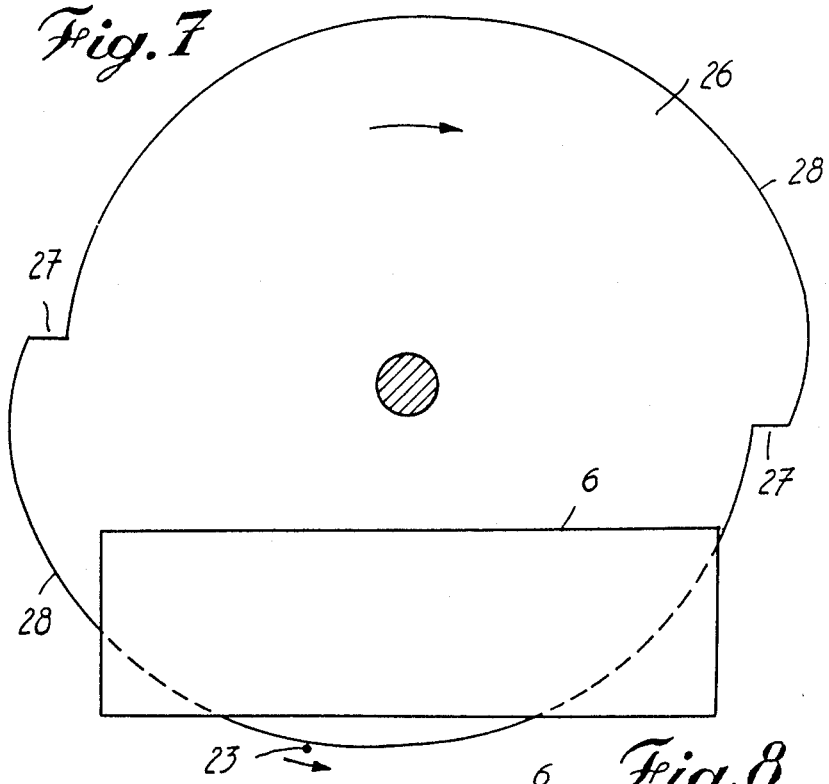

By way of example but without being in any way exhaustive, a more thorough description of an embodiment of the yarn guide device is given in accordance with the invention, in the form of a precision winding device. This description refers to the attached drawings, wherein:

FIG. 1 gives a perspective view;

FIG. 2 gives a side elevation;

FIG. 3 gives plan view of the grooved cylinder and the additional yarn guide device;

FIGS. 4 and 5 show schematically in front elevation and in cross-section the difference in the length of the yarn in its various positions with respect to the grooved cylinder;

FIG. 6 gives a plan view of the grooved cylinder, the additional yarn guide device and a curved yarn guide installed with it;

FIGS. 7, 8, 9, 10 and 11 show a plan view of the grooved cylinder and a guide disc, represented in different positions.

In FIGS. 1, 2 and 3 it will be seen that the empty bobbin 1 is fitted in the usual way on a spindle 2 between two swinging arms 3, and that the cross-wound bobbin 4 lies on bearer roll 5. Under the mounted bobbin 1 there is a rotating driven grooved cylinder 6 with a drive shaft 7 and pulley 8. This cylinder has a deep continuous helical groove 9 for the effective guiding of the yarn in one direction and a helical groove of lesser depth 10 which is interrupted by the first groove for guiding the yarn in the other direction. Under the grooved cylinder 6 there is an additional guide which in this case consists of a rotor 11 with two arms which are fastened to a drive shaft 12, where the arms are so arranged that their ends, which are provided with a notch or carrier 13, describe a curve A in front of the cylinder 6 (FIG. 3). On the drive shaft 12 a worm gear 14 is mounted which meshes with a worm 15 which is mounted on a shaft 16 carrying a pulley 17. The shaft 2 on which the empty bobbin 1 is placed, the grooved cylinder 6 and the double arm rotor 11 is driven so that they rotate by means of a motor 18 and belt transmissions 19-20-21- via belt pulleys 30-8-17. Between the two belt transmissions 20-21 there are two meshing gear wheels 31-32 for the transmission of the drive.

To obtain a cross-wound bobbin, the yarn to be wound is passed through a central fixed eye 22, laid in the deep continuous helical groove 9 of the cylinder 6 and round the bobbin 1. When the entire device is made to rotate, the yarn 23 runs from one to the other end of the bobbin 1. When the end of the bobbin is reached, the notch or carrier 13 of the double arm rotor 11 lifts the yarn out of groove 9 of the cylinder 6 and brings the yarn together with the shallow interrupted helical groove 10 by describing a curve A (FIG. 3) to the other end of the cylinder and the bobbin, where a suitably located adjustable striker 24 strikes the yarn from the arm and lays the yarn once again in continuous groove 9, after which the whole operation is repeated. In this way the yarn is cross-wound onto the bobbin. Furthermore whatsoever means can be provided for compensating the difference in length that may arise in the yarns while the yarn runs from one to the other end of the yarn (FIGS. 4 and 5), while, however, the curved path of the arms goes a long way towards this. Indeed when the yarn is wound in the middle of the bobbin, its length is artifically increased. A different means of compensating yarn length can be fitted in both yarn guide directions. It is in fact so that when the continuous groove 9 of the cylinder 6 moves the yarn, the yarn is located at the bottom of the groove, while when the rotor 11 moves the yarn, the yarn is located in the shallow interrupted groove 10 and is located almost on the surface of the cylinder 6 (FIG. 5). To this must be added the difference in yarn length caused by the deflection of the yarn from the centrally located fixed eye 22 or run-off point (FIG. 4). For more accurate yarn length compensation and when using a double-arm rotor 11, use can be made of a curved fixed guide 25 which is installed between the cylinder 6 and the curved path A described by the ends of the rotor arms (FIG. 6). Here it may be noted that when the yarn 23 is carried through the notch 13 of the rotor arm and thus lies in the shallow interrupted groove 10 of the cylinder 6, the yarn is pulled more than when it runs during its movement in the other direction by means of the deep continuous groove 9 of the cylinder over the guide 25, but because of its curved shape the yarn is pulled less when it is at the ends of the bobbin.

Figure 8:
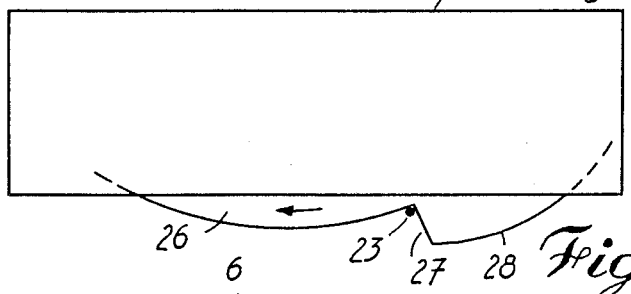
Figure 9:
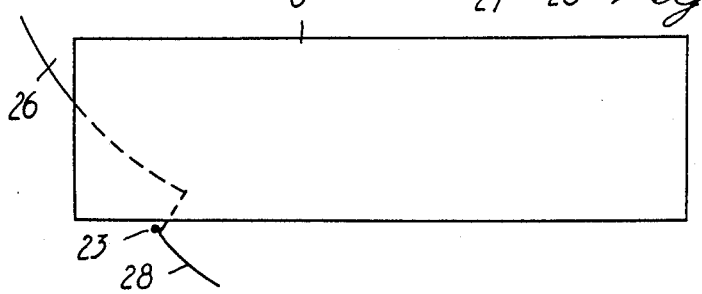
Figure 10:
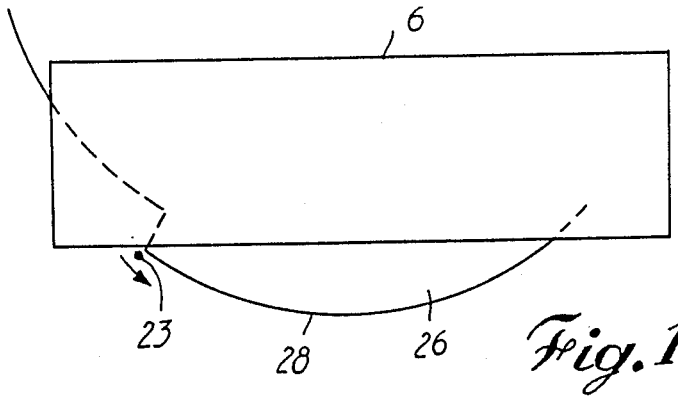
Figure 11:
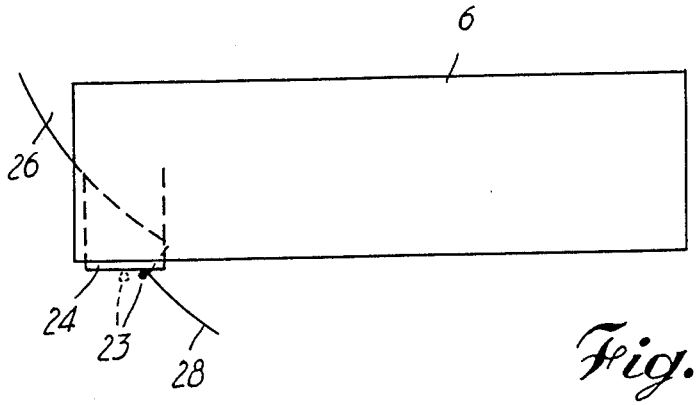

Another possibility for compensating the changing yarn length consists of replacing the arms of rotor 11 and the curved guide 25 by a rotating shaped disc 26 (FIGS. 7 to 11). Here it will be seen that the yarn 23 running through the fixed eye 22, is pushed out of the deep continuous groove 9 of the cylinder 6 and laid in the shallow interrupted groove 10 by the notch or carrier 27 of the disc 26 and moved to the other end of the bobbin 1 over a curved path (FIG. 8). When the yarn has reached this end (FIG. 9) the yarn is again placed in the deep continuous groove 9. The curved path which the yarn has followed ensures that the difference in length of the yarn during its motion is compensated. Afterwards the yarn is once again moved to the other end of the bobbin by the deep helical groove 9, where during this movement the pronouncedly curved guiding part 28 of the disc in front of the bobbin is turned, so that the yarn is forced to slide over this relatively sharply pronounced part and the difference in length of the yarn which is now located deeper in the cylinder is compensated (FIG. 10). By setting the adjustable striker element (FIG. 1) or adjustable striker plate 24 (FIG. 11) as required, the moment that the yarn is released from the disc 26 can be determined, so that the yarn falls into the desired place on the grooved cylinder 6.

Furthermore the arms of the rotor 11 or the disc 26 are shaped in such a way that a sudden jump of the yarn inwards is prevented.

It goes without saying that the shapes, the dimensions and position with respect to one another of the parts described above can differ while still remaining within the context of the patent and that some of these parts can be replaced by others which have the same purpose.

I claim:

1. Yarn guide device for the formation of cross-wound bobbins in textile machines, which device comprises:

(a) a rotating driven cylinder having over the entire length of its outer surface an uninterrupted helical groove for guiding the yarn in one direction of the transverse movement with respect to the direction of the run movement of the yarn and a helical groove running in the opposite direction to and interrupted by the first groove, for guiding the yarn in the other direction of the transverse movement of the yarn;

(b) a rotating driven rotor installed in a horizintal plane before and under said driven grooved cylinder, said rotor comprising means for lifting the yarn out of the uninterrupted groove on one end of said cylinder and for guiding to the other end of said cylinder the yarn during its transverse motion imposed by the interrupted grooved of said cylinder;

(c) means for driving the rotor with a speed having an unchanging relationship to the speed of rotation of the grooved cylinder; and (d) a striker provided on one end and before the grooved cylinder for striking-off the yarn from the rotor and for laying the yarn in the uninterrupted groove of said cylinder.

2. Yarn guide device as defined in claim 1 in which the continuous helical groove is deeper than the interrupted helical groove of the grooved cylinder.

3. Yarn guide device as defined in claim 1 comprising a curved guide provided between the grooved cylinder and the curved path followed by the rotor and in front of the grooved cylinder, for guiding the yarn to be wound up and for compensating the difference in length of the yarn between a fixed central guide eye and the central part of the bobbin to be wound and between said central guide eye and both ends of said bobbin.

4. Yarn guide device as defined in claim 1 in which the rotating driven rotor consists of a rotating driven shaped disc, said disc including on its circumference two carriers for carrying the yarn in a curved path before the grooved cylinder and a pronouncedly curved guiding part beyond said curved path and between said carriers to obtain an optimal yarn length compensation.

5. Yarn guide device as defined in claim 1 in which the striker is adjustable with regard to the grooved cylinder.

* * * * *